US011629726B2

(12) United States Patent
Gruber et al.

(10) Patent No.: US 11,629,726 B2
(45) Date of Patent: Apr. 18, 2023

(54) CENTRIFUGAL OR DIAGONAL IMPELLER WITH MODIFIED BLADE EDGE

(71) Applicant: ebm-papst Mulfingen GmbH & Co. KG, Mulfingen (DE)

(72) Inventors: Erhard Gruber, Satteldorf (DE); Michael Strehle, Ingelfingen (DE); Daniel Gebert, Öhringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/869,046

(22) Filed: Jul. 20, 2022

(65) Prior Publication Data

US 2023/0038614 A1 Feb. 9, 2023

(30) Foreign Application Priority Data

Jul. 23, 2021 (DE) ..... 102021119121.1

(51) Int. Cl.
*F04D 29/28* (2006.01)
*F04D 29/30* (2006.01)

(52) U.S. Cl.
CPC ..... *F04D 29/283* (2013.01); *F04D 29/30* (2013.01)

(58) Field of Classification Search
CPC ..... F04D 29/282; F04D 29/283; F04D 29/30
See application file for complete search history.

(56) References Cited

U.S. PATENT DOCUMENTS

| | | | | |
|---|---|---|---|---|
| 11,193,494 | B2 * | 12/2021 | Cho | F04D 29/284 |
| 2017/0284412 | A1 | 10/2017 | Jonen | |
| 2019/0024674 | A1 | 1/2019 | Loercher et al. | |
| 2019/0120245 | A1 * | 4/2019 | Konzal | F04D 29/281 |
| 2019/0293083 | A1 | 9/2019 | Ishii et al. | |
| 2019/0316596 | A1 * | 10/2019 | Munts | F04D 29/242 |
| 2021/0372426 | A1 * | 12/2021 | Gebert | F04D 29/30 |

FOREIGN PATENT DOCUMENTS

EP 2461041 A1 6/2012

OTHER PUBLICATIONS

European Office Action dated Dec. 19, 2022 in corresponding European Application No. 22183867.5.

* cited by examiner

*Primary Examiner* — Sabbir Hasan
(74) *Attorney, Agent, or Firm* — Harness, Dickey & Pierce, P.L.C.

(57) ABSTRACT

A centrifugal or diagonal impeller has impeller blades (4) that are curved in the circumferential direction about an axis of rotation and are formed from a single-layer sheet metal. Each blade (4) has a suction side (11) and a pressure side (12) as well as a blade leading edge (5) and a blade trailing edge (6). At least the blade leading edge (5) of the impeller blades (4) adjacent to their suction side (11) have a geometric edge modification in the form of a rounding (7) over a predetermined partial length of a blade thickness (SD) of the impeller blades (4).

13 Claims, 3 Drawing Sheets

CENTRIFUGAL OR DIAGONAL IMPELLER WITH MODIFIED BLADE EDGE

CROSS-REFERENCE TO RELATED APPLICATION

This application claims the benefit and priority of German Application No. 10 2021 119 121.1, filed on Jul. 23, 2021. The entire disclosure of the above application is incorporated herein by reference.

FIELD

The disclosure relates to a centrifugal or diagonal impeller for a blower with impeller blades that are made of sheet metal and curved in the circumferential direction about an axis of rotation.

BACKGROUND

Centrifugal or diagonal impellers made of various materials are known from the prior art. In particular, depending on the desired place of use and application, both plastics—some fiber-reinforced—and metals in the form of sheets are used. Fan wheel blades made of sheet metal are manufactured either as hollow profile blades or with a constant material thickness.

The sheet metal curved fan wheel blades are usually produced by a metal forming process and blanked from the raw material. This results in a blunt blade end on both the blade leading edge and the blade trailing edge, with two respective sharp edges at the ends of the two oppositely situated blade surfaces that fluidically determine the suction side and the pressure side of the respective impeller blade. Such impeller blades can be used immediately in the impeller without secondary processing.

SUMMARY

It is the object of the disclosure to provide a centrifugal or diagonal impeller, with curved impeller blades formed from a single-layer sheet metal, that has increased efficiency compared to conventional impellers.

According to the disclosure, a centrifugal or diagonal impeller has impeller blades that are curved about its axis of rotation in the circumferential direction. The impeller blades are formed from a single layer of sheet metal. Each blade has a suction side and a pressure side as well as a blade leading edge and a blade trailing edge. In addition, at least the blade leading edge of the impeller blades has a geometric edge modification, in the form of a rounding, that is limited to the suction side over a predetermined partial length of the full blade thickness.

Single-layer sheet metal impeller blades are usually manufactured and shaped in a forming process. The outer geometry is achieved by blanking the sheet metal, resulting in blunt surface edges of the flat sheet metal raw material with two sharp outer edges (beveled shape). From an aerodynamic perspective, airfoil profiles are known to be better suited, but these cannot be produced using single-layer sheet metal. The advantage of the single-layer sheet is that any free-form surfaces can be created as three-dimensionally curved impeller blades, which is not possible or only possible to a limited extent with hollow profiles. The edge modification, in the form of a rounding, on the suction side of the blade leading edge achieves an effect comparable to an ideally designed flow profile and thus increases the efficiency of the impeller. As a matter of principle, it is sufficient to provide only the leading edge of the blade on the suction side with the edge modification in order to achieve the improved efficiency. All other edges of the blade edges can be left without an edge modification and thus remain free of secondary processing after forming through blanking.

The blade leading edge of the impeller blades, adjacent to the pressure side, is preferably formed without the edge modification and retains the beveled shape created by blanking.

The edge modification, in the form of a rounding, is achieved by providing a continuous, constant radius on the suction-side sharp outer edge of the surface edges of the flat sheet metal raw material remaining after the raw material has been blanked. The profile of the edge modification can also have a plurality of different radii.

The advantageous effect is also achieved in a design variant where the edge modification has an elliptical shape in the form of a rounding.

As another option for edge modification, in the form of a rounding, one solution provides the rounding formed by a bevel. The bevel can also have the usual discontinuous profile when viewed in cross section. The resulting transition is nevertheless defined as a rounding, since a sharp outer edge on the surface edges of the flat sheet metal raw material is eliminated by an edge modification that has a positive effect on the flow.

However, one design variant of the centrifugal or diagonal impeller includes the trailing edge of the impeller blades, adjacent to the pressure side, with a geometric edge modification, in the form of a rounding, over a predetermined partial length of the blade thickness. The variants described above can be used here. The edge modification of the blade trailing edge on the pressure side improves noise generation and thus provides additional acoustic advantages. In one favorable embodiment, the blade leading edge and the blade trailing edge of the impeller blades are designed to be identical in shape with regard to the edge modification.

The edge modification is therefore formed starting from the suction side of the impeller blades on the blade leading edge, and starting from the pressure side on the blade trailing edge.

Furthermore, in one advantageous embodiment, the centrifugal or diagonal impeller includes the edge modification along the blade leading edge on the suction side. It starts from an outermost edge of the blade leading edge in the direction of the pressure side of the blade leading edge and extends as a partial length over at least 20% of the blade thickness.

If the blade trailing edge also includes an edge modification, it starts from an outermost edge of the blade trailing edge in the direction of the suction side of the blade trailing edge. Thus, the edge modification along the blade trailing edge on the pressure side extends as a partial length over at least 20% of the blade thickness.

In the case of the centrifugal or diagonal impeller, it is advantageous that the impeller blades have a constant blade thickness and the sheet metal material has a constant material thickness.

The centrifugal or diagonal impeller also includes impeller blades that are three-dimensionally curved between the blade leading edge and the blade trailing edge, by a forming process. The three-dimensional curvature enables aerodynamically advantageous airfoil profiles to be imitated. However, the effort and expense required to manufacture three-dimensionally curved impeller blades from single-layer sheet metal is far less.

The centrifugal or diagonal impeller also comprises a bottom disc and a cover disc that are connected by the impeller blades. The cover disc can be configured in a number of ways. In particular, it can be undulated and/or rotationally symmetrical in the circumferential direction.

In order to produce the edge modification, edge embossing can be performed in the forming tool before the impeller blades are mounted in the impeller. Alternatively, the edge trimming can be performed in the form of peripheral edge trimming of the impeller blades with integrated forming. Finally, machining of the blade edges would also be possible.

The features disclosed above can be combined as required, provided this is technically possible and they do not contradict one another.

Further areas of applicability will become apparent from the description provided herein. The description and specific examples in this summary are intended for purposes of illustration only and are not intended to limit the scope of the present disclosure.

DRAWINGS

Other advantageous refinements of the disclosure are disclosed in the in the subclaims and/or depicted in greater detail below together with the description of the preferred embodiment of the disclosure with reference to the figures. In the drawing:

Figure 1:
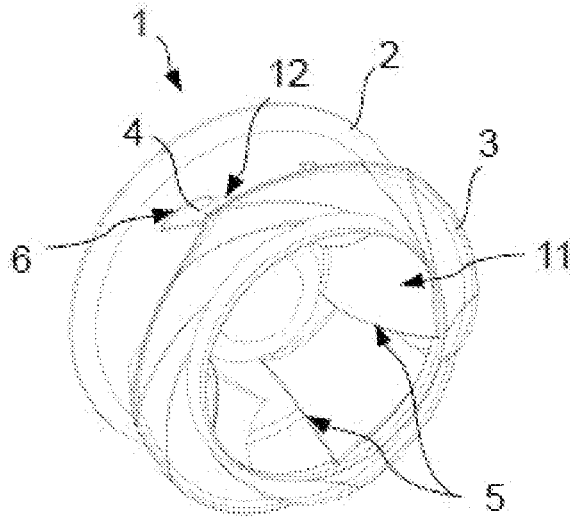
FIG. 1 is a perspective view of a centrifugal impeller.
Figure 2:
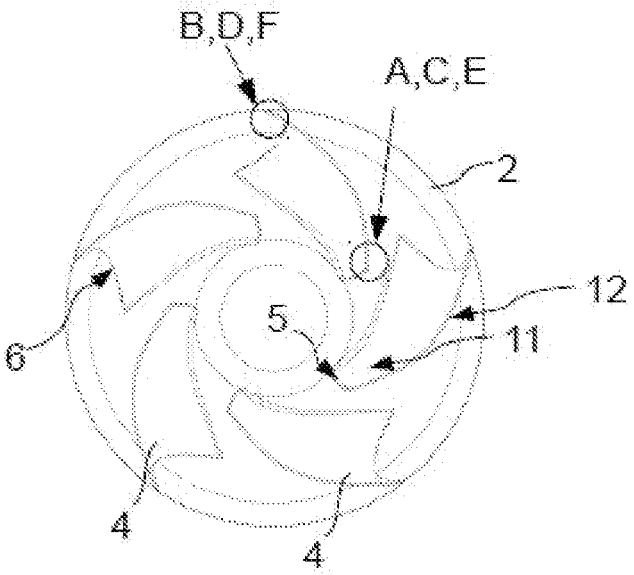
FIG. 2 is a section view through the centrifugal impeller of FIG. 1.
Figure 3A:
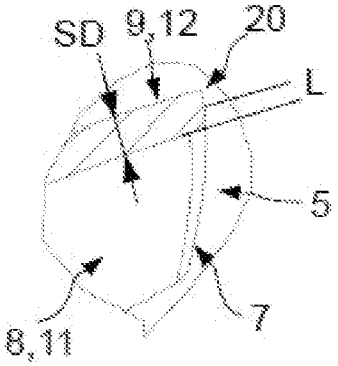
Figure 3B:
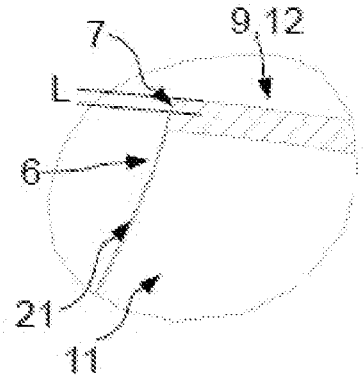
Figure 4A:
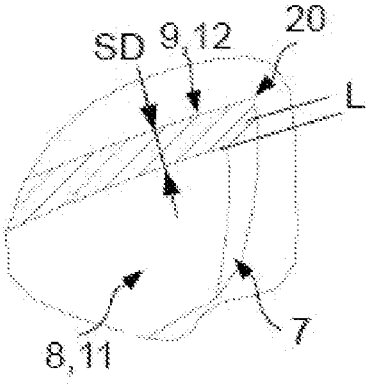
Figure 4B:
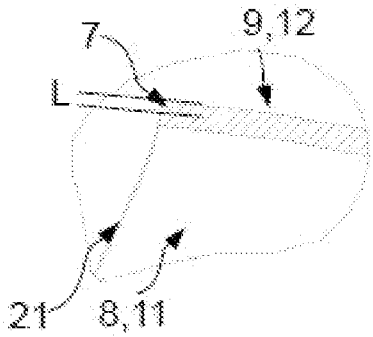
Figure 5A:
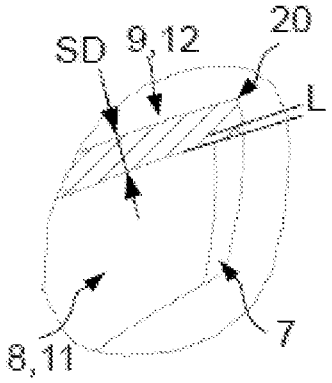
Figure 5B:
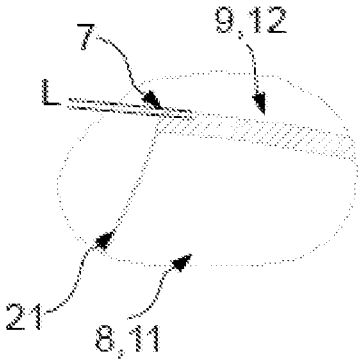
Figure 6:
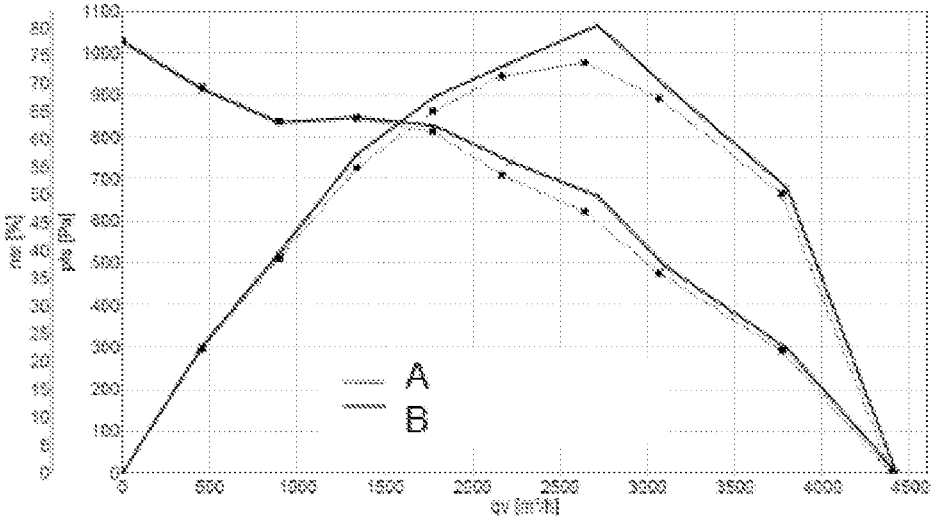

FIG. 3*a* is a detailed cross-section view of a blade leading edge of the centrifugal impeller of FIGS. 1 and 2 (detail A);

FIG. 3*b* is a detailed cross-section view of a blade trailing edge of the centrifugal impeller of FIGS. 1 and 2 (detail B);

FIG. 4*a* is a detailed cross-section view of the blade leading edge of the centrifugal impeller in an alternative embodiment (detail C);

FIG. 4*b* is a detailed cross-section view of the blade trailing edge of the centrifugal impeller in an alternative embodiment (detail D);

FIG. 5*a* is a detailed cross-section view of the blade leading edge of the centrifugal impeller in another alternative embodiment (detail E);

FIG. 5*b* is a detailed cross-section view of the blade trailing edge of the centrifugal impeller in another alternative embodiment (detail F); and FIG. 6 is a diagram of the qualitative increase in efficiency.

DETAILED DESCRIPTION

The disclosure is explained in more detail in the following by using a preferred exemplary embodiment with reference to FIG. 1.

FIG. 1 shows an exemplary centrifugal impeller 1. However, the disclosure can also be applied directly to diagonal impellers where the outflow direction is not radial, but diagonal. The centrifugal impeller 1 includes a bottom disc 2, a rotationally symmetrical cover disc 3, and impeller blades 4 that extend therebetween and are arranged around the axis of rotation. The cover disc 3 forms the axially centered intake opening. The centrifugal impeller 1 is made of sheet metal, with the impeller blades 4 being connected, particularly welded, to the bottom disc 2 and the cover disc 3.

The impeller blades 4 are made from a single-layer sheet metal with a constant material thickness and blade thickness SD. On the one hand, the blades 4 are curved backward against the intended direction of rotation of the centrifugal impeller 1, when used as intended. On the other hand, the blades 4 are curved three-dimensionally by a forming process, as can clearly be seen not only in FIG. 1 but also in the axial section of FIG. 2.

In the embodiment shown, each of the impeller blades 4 is identical in shape. Each includes a respective suction side 11 and pressure side 12, as well as a blade leading edge 5 on the suction side and a blade trailing edge 6 on the outlet side.

With reference to the detailed view according to FIG. 3*a*, the suction-side blade leading edges 5 of the impeller blades 4 have a geometric edge modification in the form of a rounding 7 with a continuous radius. In the embodiment shown, the edge modification, in the form of the rounding 7, extends over the entire axial length along the blade leading edge 5. It starts from an outermost edge of the blade leading edge 5 on the suction side 11 in the direction of the pressure side 12 over a partial length L. The length L corresponds to approximately 50% of the blade thickness SD. The beveled end 20 of the blade leading edge 5 on the pressure side 12 is sharp-edged and, in particular, forms a transition at right angles.

In the exemplary embodiment shown in FIGS. 1 and 2, the blade trailing edges 6 are also provided with the rounding 7. It starts from the pressure side 12 in the direction of the suction side 11 of the respective impeller blade 4, as shown in the detailed view of FIG. 3*b*. The beveled end 21 of the blade trailing edge 6 on the suction side 11 is also sharp-edged, as is the case with the blade leading edge 5, and particularly also forms a transition at right angles.

Alternative design variants of the edge modification in the form of a rounding 7 are shown in the exemplary embodiments of FIGS. 4*a* and 5*a*, for the blade leading edges 5, and in FIGS. 4*b* and 5*b*, for the blade trailing edges 6. In the exemplary embodiment according to FIGS. 4*a*, 4*b*, the edge modification is implemented in the form of a rounding 7 by a bevel. In the exemplary embodiment according to FIGS. 5*a*, 5*b*, the edge modification is implemented in the form of a rounding 7 in an elliptical shape that extends farther along the chord length of the impeller blades 4. The partial length L is then less than in the solution according to FIGS. 3*a*, 3*b* and is only approximately 20% of the blade thickness SD.

FIG. 6 shows a diagram comparing the efficiency of two identical centrifugal impellers. Dashed line A shows the characteristic curve of the centrifugal impeller with conventional blade leading edges. Line B shows the characteristic curve of the centrifugal impeller 1 with blade leading edges 6 with edge modification in the form of the rounding 7. The increase in efficiency due to the edge modification in the form of the rounding 7 is observed particularly with volume flows in the range of 1000-4000 $m^3/h$ and is significant in the range of 1500-3000 $m^3/h$.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A centrifugal or diagonal impeller comprising:

impeller blades curved in the circumferential direction about an axis of rotation and formed from a single-layer sheet metal;

each blade has a suction side, a pressure side as well as a blade leading edge and a blade trailing edge; and at least the blade leading edge of the impeller blades adjacent to their suction side has a geometric edge modification in the form of a rounding that is limited over a predetermined partial length of a blade thickness of the impeller blades, wherein the blade leading edge of the impeller blades adjacent to their pressure side is formed without the edge modification and has a beveled shape.

2. The centrifugal or diagonal impeller as set forth in claim 1, wherein the blade trailing edge of the impeller blades adjacent to the pressure side has a geometric edge modification in the form of a rounding over a predetermined partial length of the blade thickness.

3. The radial or diagonal impeller as set forth in claim 1, wherein the impeller blades have a constant blade thickness.

4. The radial or diagonal impeller as set forth in claim 1, wherein the rounding has a constant radius.

5. The centrifugal or diagonal impeller as set forth in claim 1, wherein the rounding is formed by a plurality of radii.

6. The centrifugal or diagonal impeller as set forth in claim 1, wherein the rounding is elliptical.

7. The centrifugal or diagonal impeller as set forth in claim 1, wherein the rounding is formed by a bevel.

8. The centrifugal or diagonal impeller as set forth in claim 1, wherein the blade leading edge and the blade trailing edge have an initial shape by edge trimming, and the initial shape includes the edge modification through a forming process.

9. The centrifugal or diagonal impeller as set forth in claim 1, wherein the edge modification along the blade leading edge on the suction side, starting from an outermost edge of the blade leading edge in the direction of the pressure side of the blade leading edge, extends as a partial length over at least 20% of the blade thickness.

10. The centrifugal or diagonal impeller as set forth in claim 1, wherein the edge modification along the blade trailing edge on the pressure side starting from an outermost edge of the blade trailing edge in the direction of the suction side of the blade trailing edge extends as a partial length over at least 20% of the blade thickness.

11. The centrifugal or diagonal impeller as set forth in claim 1, wherein the impeller blades are three-dimensionally curved between the blade leading edge and the blade trailing edge by a forming process.

12. The centrifugal or diagonal impeller as set forth in claim 1, wherein a bottom disc and a cover disc are connected by the impeller blades.

13. The centrifugal or diagonal impeller as set forth in claim 12, wherein the cover disc is undulated and/or rotationally symmetrical in the circumferential direction.

* * * * *